United States Patent [19]

Freese

[11] 4,029,157

[45] June 14, 1977

[54] MATERIAL PUSHING VEHICLE HAVING PIVOTAL BLADE PORTION

[75] Inventor: Gary P. Freese, Joliet, Ill.

[73] Assignee: Caterpillar Tractor Co., Peoria, Ill.

[22] Filed: May 28, 1976

[21] Appl. No.: 691,123

[52] U.S. Cl. ..... 172/801; 172/806

[51] Int. Cl.[2] ..... E02F 3/76

[58] Field of Search ..... 172/801, 802, 806, 809; 37/42 VL

[56] References Cited

UNITED STATES PATENTS

| | | | |
|---|---|---|---|
| 1,926,011 | 9/1933 | Soule | 37/44 |
| 2,055,291 | 9/1936 | Henry | 37/42 VL |
| 2,999,697 | 9/1961 | Winget | 172/801 |
| 3,265,380 | 8/1966 | Hall | 172/801 |
| 3,279,105 | 10/1966 | Kolinger | 172/801 |
| 3,775,877 | 12/1973 | Gove | 37/42 VL |

FOREIGN PATENTS OR APPLICATIONS

| | | | |
|---|---|---|---|
| 47-20503 | 6/1972 | Japan | 172/802 |

*Primary Examiner*—Richard J. Johnson
*Attorney, Agent, or Firm*—Frank L. Hart

[57] ABSTRACT

A work vehicle of the material pushing type has a blade having first and second portions. The second blade portion is pivotally movable in response to forces subjected thereupon. Biasing means is provided for urging the second blade portion in a preselected direction.

4 Claims, 6 Drawing Figures

FIG. 2
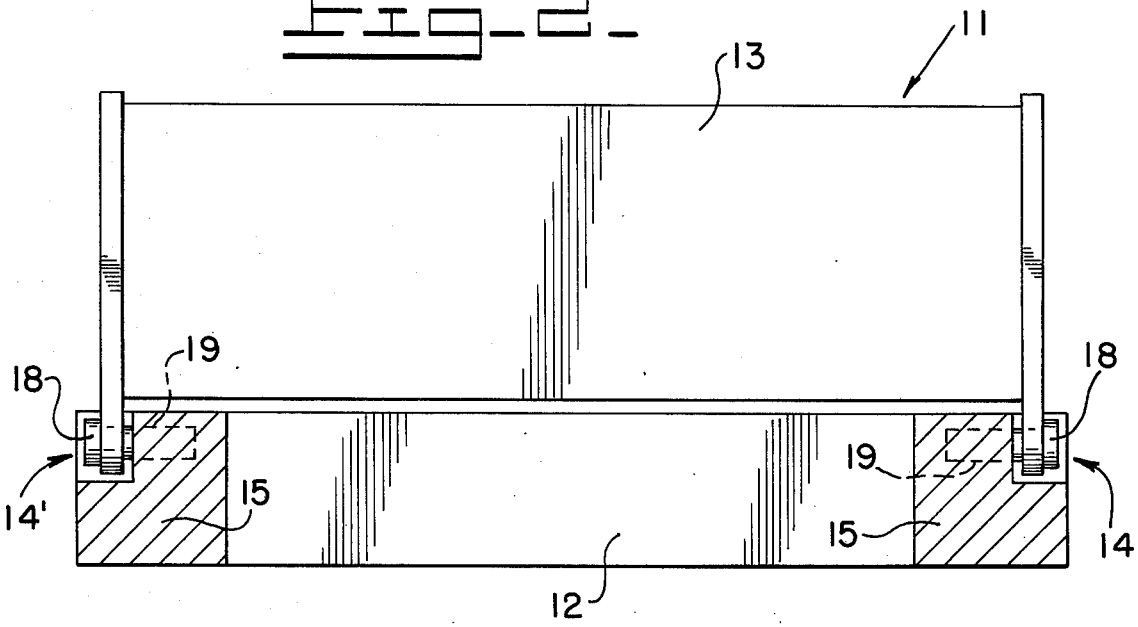
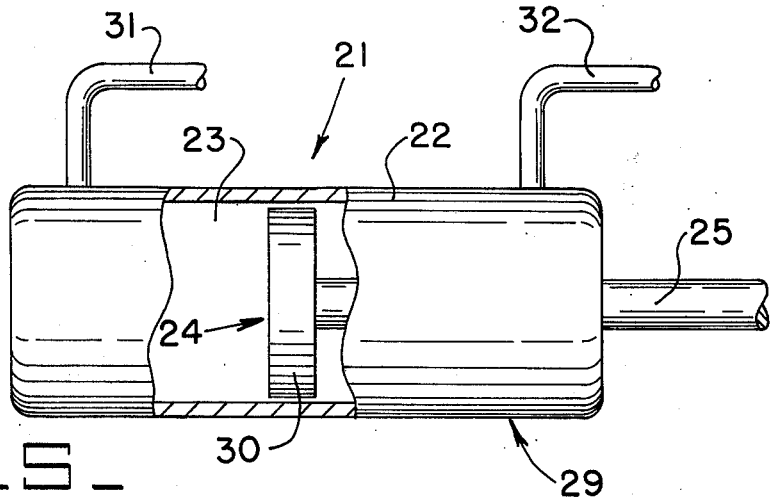
FIG. 5
FIG. 6
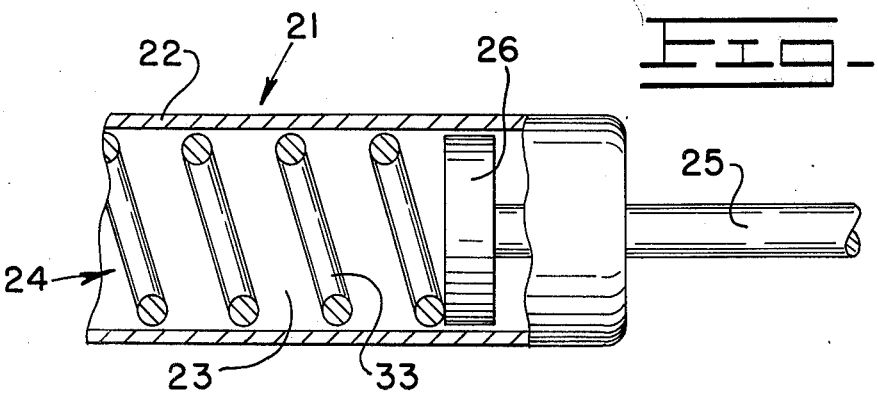

MATERIAL PUSHING VEHICLE HAVING PIVOTAL BLADE PORTION

BACKGROUND OF THE INVENTION

In the operation of material pushing vehicles, for example track-type tractors having a front mounted blade, the vehicle is often used for pushing another vehicle. During these power assist operations, it is desirable that at least one of the contacting elements of the vehicles have a controllable amount of force absorbing properties in order to improve the smoothness of the subjection of the force of one vehicle onto the other.

The apparatus of this invention solves this problem by constructing a blade having a pivotally movable second portion associated with a biasing means.

BRIEF DESCRIPTION OF THE DRAWINGS

FIG. 2 is a diagrammatic rear view of the blade;

FIGS. 4–6 are diagrammatic partial sectional views of different embodiments of the biasing means.

DETAILED DESCRIPTION OF THE INVENTION

Figure 1:
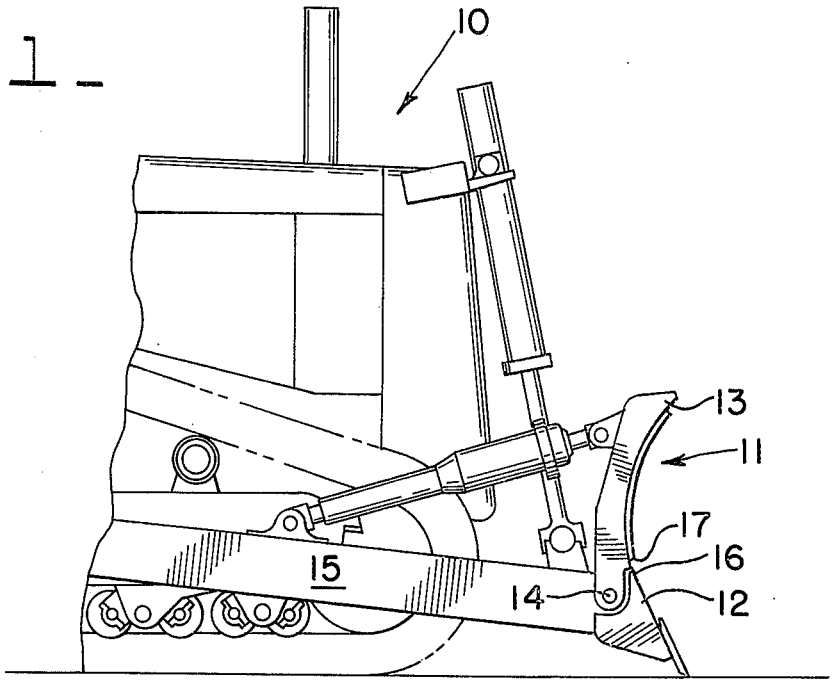
FIG. 1 is a diagrammatic side view of a vehicle having the apparatus of this invention.

Referring to FIG. 1, a work vehicle 10 of the material pushing type, for example a crawler tractor, has a material pushing blade 11 fixed thereto.

The blade 11 has first and second portions 12, 13 each of which extend generally horizontally as better seen in FIG. 2.

Means 14 are provided for pivotally connecting the blade portions 12, 13 one to the other for pivotal movement of the second blade portion 13 between first and second positions. The first portion 12 of the blade 11 is fixed to a push arm assembly 15 or frame portion of the vehicle 10. The second portion 13 of the blade 11 can be pivotally connected to the push arm assembly 15 by a plurality of connecting means 14, 14′ extending along abutting edges 16, 17 of the blade portions 12, 13, as shown in FIG. 2. The connecting means 14 can have a pin 18 extending through an opening 19 of the push arm assembly 15, as best seen in FIG. 3, or can be of other construction.

Figure 3:
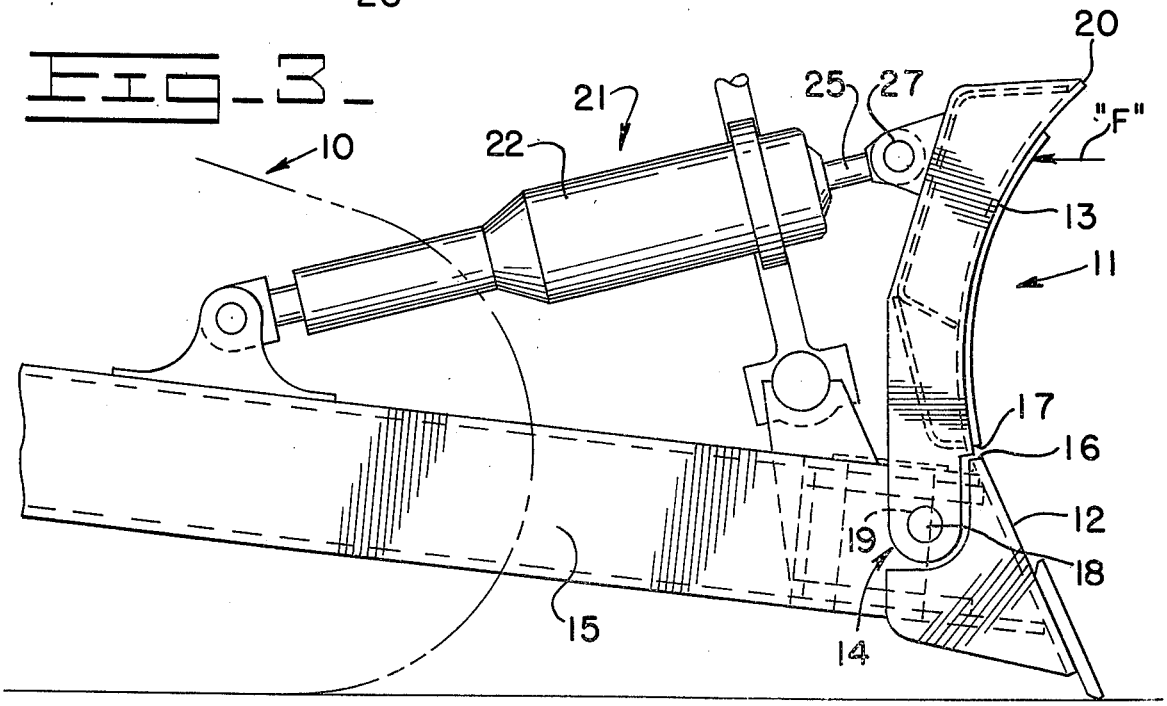
FIG. 3 is a diagrammatic side view of a portion of the blade assembly.

The second blade portion 13 is movable between a first position shown by solid lines in FIGS. 1 and 3, at which the blade portion 12, 13 define an arc of preselected configuration and a second position, shown by broken lines, at which portions of an upper edge portion 20 of the second blade portion 13 is spaced from the first position in a direction toward the rear of the vehicle 10.

The second blade portion 13 is movable to and toward the second position by forces "F" subjected upon said blade portion 13 in response to the vehicle 10 pushing another vehicle, for example. The second blade portion 13 is urged toward the first position by a biasing means 21.

Figure 4:
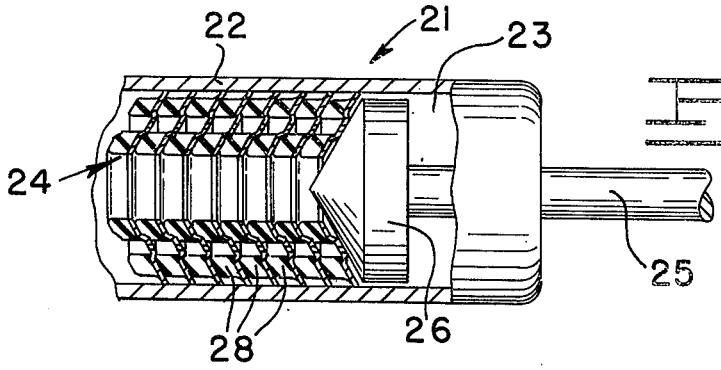

Referring to FIGS. 3 and 4, the biasing means 21 has a cylinder housing 22 having a chamber 23 and is connected at one end to the vehicle 10, for example push arm 15. A biasing element means 24 is positioned within the housing chamber 23.

An actuating element 25 having first and second ends 26, 27 is associated with the housing 22. The first end 26 of the actuating element 25 is within the chamber 23 and the second end 27 is connected to the second portion 13 of the blade 11, preferably adjacent the uppermost edge portion 20. The actuating element second end 27 is movable against the biasing element 24 in response to forces subjected onto the second portion 13 of the blade 11.

In the embodiment of FIG. 4, the biasing element is a multiplicity or resilient elements 28 of frustoconical configuration. These elements 28 can be formed of rubber or other materials. In the embodiment of FIG. 5, the biasing element 24 is a double acting hydraulic assembly 29 having a piston 30 and first and second hydraulic lines 31, 32. In the embodiment of FIG. 6, the biasing element 24 is a helical spring 33.

In the operation of the apparatus, forces "F" subjected on the second portion 13 of the blade 11 are partially absorbed and/or repressed by the pivotal movement of the blade second portion and the biasing element 24. Upon removal of the force "F", the biasing element 24 causes the blade second portion 13 to return to the first position.

The construction of the biasing element 24 is dependent upon the forces "F" which are expected to be connected during pushing of other vehicles, for example, and the normal forces subjected thereupon during normal operation of, for example, pushing dirt. Once these forces have been determined, one skilled in the art can easily determine the reaction forces desired to be imparted by the biasing element 24.

Other aspects, objects, and advantages of this invention can be obtained from a study of the drawings, the disclosure, and the appended claims.

What is claimed is:

1. In a work vehicle of the material pushing type having a material pushing blade fixed to the vehicle, the improvement comprising:
   - a push arm assembly having an opening and being connected to the vehicle;
   - said blade having first and second generally horizontally extending portions each having faces of a construction sufficient for contacting and pushing material, said first blade portion being connected to the push arm assembly;
   - means for pivotally connecting the blade portions one to the other for pivotal movement of the second blade portion between a first position at which the faces of the blade portions define an arc of preselected configuration and a second position at which portions of the second blade portion face are spaced from said first position in response to forces subjected upon said second blade portion, said means including a pin extending through the opening of the push arm assembly; and
   - means for urging the second portion of the blade toward the first position.

2. Apparatus, as set forth in claim 1, wherein the means for urging comprises:
   - a cylinder housing having a chamber and being connected at one end to the vehicle;
   - a biasing element positioned within the housing chamber; and
   - an actuating element having first and second ends, said first end being within the chamber, said second end being connected to the second portion of the blade and movable against the biasing element in response to forces subjected onto the blade second portion.

3. Apparatus, as set forth in claim 2, wherein the biasing element is a multiplicity of resilient elements of generally frustoconical configuration.

4. Apparatus, as set forth in claim 1, wherein there are a plurality of connecting means extending along abutting edges of the first and second blade portions for pivotally connecting the first blade portions to the vehicle.

* * * * *